US010214035B2

(12) United States Patent
Ue et al.

(10) Patent No.: US 10,214,035 B2
(45) Date of Patent: Feb. 26, 2019

(54) RECORDING APPARATUS WITH RECEIVING TRAY HAVING PROJECTING SECTIONS

(71) Applicant: SEIKO EPSON CORPORATION, Tokyo (JP)

(72) Inventors: Hiroshi Ue, Matsumoto (JP); Koji Migita, Matsumoto (JP); Satoshi Iwaya, Ina (JP); Yasushi Akatsuka, Asahi-Mura (JP); Hiroshi Shiohara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/805,583

(22) Filed: Nov. 7, 2017

(65) Prior Publication Data

US 2018/0147864 A1 May 31, 2018

(30) Foreign Application Priority Data

Nov. 25, 2016 (JP) ..... 2016-229115

(51) Int. Cl.

| | |
|---|---|
| ***B41J 13/00*** | (2006.01) |
| ***B41J 2/01*** | (2006.01) |
| ***B65H 31/02*** | (2006.01) |
| ***B65H 31/20*** | (2006.01) |
| ***B65H 31/22*** | (2006.01) |
| ***B65H 43/00*** | (2006.01) |
| *B41J 13/10* | (2006.01) |

(52) U.S. Cl.

CPC ..... *B41J 13/0036* (2013.01); *B41J 2/01* (2013.01); *B65H 31/02* (2013.01); *B65H 31/20* (2013.01); *B65H 31/22* (2013.01); *B65H 43/00* (2013.01); *B41J 13/106* (2013.01); *B65H 2301/4212* (2013.01); *B65H 2403/411* (2013.01); *B65H 2405/1111* (2013.01); *B65H 2405/11151* (2013.01); *B65H 2405/11163* (2013.01); *B65H 2511/10* (2013.01); *B65H 2511/20* (2013.01)

(58) Field of Classification Search

CPC .... B41J 13/0036; B41J 13/106; B41J 13/001; B41J 13/01; B41J 11/006

See application file for complete search history.

(56) References Cited

U.S. PATENT DOCUMENTS

| | | | | |
|---|---|---|---|---|
| 7,448,617 | B2 * | 11/2008 | Fujioka | B41J 13/106 271/207 |
| 7,748,705 | B2 | 7/2010 | Yamada | |
| 2009/0200736 | A1 | 8/2009 | Seki | |
| 2009/0212497 | A1 * | 8/2009 | Kawaguchi | B65H 29/242 271/308 |

(Continued)

FOREIGN PATENT DOCUMENTS

| | | | |
|---|---|---|---|
| JP | 60-180261 | U | 11/1985 |
| JP | 2002-060111 | A | 2/2002 |

(Continued)

*Primary Examiner* — Henok Legesse
(74) *Attorney, Agent, or Firm* — Workman Nydegger

(57) ABSTRACT

Provided are a recording apparatus, when a medium is discharged from a recording apparatus main body, which can achieve both of appropriate mounting of a medium in which the leading edge thereof is curled on a medium receiving tray, and reduction of damage to a medium when mediums of different sizes are mixed on the medium receiving tray.

10 Claims, 13 Drawing Sheets

(56) References Cited

U.S. PATENT DOCUMENTS

2011/0221845 A1 9/2011 Ue

FOREIGN PATENT DOCUMENTS

| | | | |
|---|---|---|---|
| JP | 2008-297042 | A | 12/2008 |
| JP | 2009-190816 | A | 8/2009 |
| JP | 2011-143990 | A | 7/2011 |
| JP | 2011-190000 | A | 9/2011 |
| JP | 2012-101926 | A | 5/2012 |
| JP | 2013-163591 | A | 8/2013 |

* cited by examiner

RECORDING APPARATUS WITH RECEIVING TRAY HAVING PROJECTING SECTIONS

BACKGROUND

1. Technical Field

The present invention relates to a recording apparatus for recording on a medium.

2. Related Art

There is a recording apparatus, represented by an ink jet printer, that is provided with a discharge unit such as a pair of discharge rollers on the downstream side of a recording unit that records on paper as a medium, and is configured such that the recorded paper is discharged to the outside of the apparatus and is stacked on a medium receiving tray (also referred to as stacker) for receiving a plurality of the discharged paper in the discharged order.

When recording is performed by ejecting liquid (ink) to paper, there is a case where the recorded surface of the paper curls facing outward. Paper generally has paper grain (flowing grain of fibers formed during papermaking process) and the curl occurs such that both sides of the paper along the paper grain approach each other on the paper. In the recording apparatus, in a case where the paper grain of the paper is set to "grain-long" in which the paper grain is along a paper transport direction in the recording apparatus, the paper curls to a paper width direction intersecting the paper transport direction.

On the other hand, in a case where the paper grain of the paper is set to "grain-short" in which the paper grain is along the paper width direction, the paper curls to the paper transport direction. That is, the curl occurs such that the leading edge side and the rear edge side of the paper approach each other. The fiber on the liquid-ejected surface of the paper is expanded due to moisture and the liquid-ejected surface curls to the opposite side of the paper. When liquid is ejected on paper at high duty, the amount of the curl thereof further increases. In a case where liquid is ejected from the upper direction of the paper and the paper is discharged in the state (so-called face up state), there is a case where the paper curls downward from the leading edge thereof, is rounded such as a scroll before the leading edge of the discharged paper is landed on the medium receiving tray, and consequently, is not appropriately stacked on the medium receiving tray.

In order to prevent this, for example, an image-forming apparatus 100 is disclosed in JP-A-2012-101926. The image-forming apparatus includes a stacking-position changing member 63, capable of projecting from a mounting surface (second tray surface 60*b*), on a paper discharge tray 60 as the medium receiving tray, and can make a level difference h2 from a paper discharge port 51 to the stacking-position changing member 63 smaller than a level difference h1 from the paper discharge port 51 to the lowermost section of the second tray surface 60*b*. When paper that the leading edge thereof tends to curl is discharged in the image-forming apparatus 100, by causing the stacking-position changing member 63 to project, the leading edge of the paper can be brought into contact with the stacking-position changing member 63 before the leading edge of the paper curls, so that the paper can appropriately be stacked on the paper discharge tray 60.

In JP-A-2013-163591, a pair of supporting members 54 (first member 54*a* and second member 54*b*) that can be projected is provided on the lower side of a processing tray 34 as a discharge section for discharging a sheet from an apparatus main body, and on the upper side of a paper discharge tray 52 for mounting the discharged sheet. JP-A-2013-163591, similarly to JP-A-2012-101926, when paper that the leading edge thereof tends to curl is discharged, by causing the supporting member 54 to project, the paper can be brought into contact with the supporting member 54 before the leading edge of the paper curls, so that the paper can appropriately be stacked.

In JP-A-2012-101926 that one stacking-position changing member 63 is provided on the center section in the width direction of the medium receiving tray, paper is supported by one point. Accordingly, when the number of stacked paper increases, there is a possibility that paper on the lower side is pushed against the stacking-position changing member 63 due to the weight of a paper bundle, and is bent or scratched.

In JP-A-2013-163591, a paper bundle is supported by two points of the first member 54*a* and the second member 54*b*. Accordingly, bending of the paper bundle is unlikely to occur compared with a configuration described in JP-A-2012-101926.

In a case of a recording apparatus capable of recording on paper of a plurality of types of sizes, when another size (second size) paper is recorded next while first size paper, recorded previously, is stacked on the medium receiving tray, pieces of paper of different sizes may be mixed on the medium receiving tray.

When pieces of paper of different sizes are mixed on the medium receiving tray, in a case where the second size paper, discharged later, is smaller than the first size paper, discharged previously, and particularly, a width size of the second size paper is narrower than a space between the first member 54*a* and the second member 54*b*, there is a possibility that the first size paper, stacked on the medium receiving tray previously, is pushed against the first member 54*a* and the second member 54*b* due to the weight of second size paper, stacked later, and the first size paper is bent or scratched.

In particular, in a case where a long side of a large size paper (for example, A3 size) is transported along a medium transport direction, when the paper is "grain-short", the growth rate of the curl at the leading edge of the large size paper is fast and the leading edge thereof is easy to round. Accordingly, there is an increased possibility that the large size paper is not appropriately stacked on the medium receiving tray.

SUMMARY

An advantage of some aspects of the invention is to provide a recording apparatus, when a medium is discharged from a recording apparatus main body, which can achieve both of appropriate mounting of a medium which tends to curl on a medium receiving tray and reduction of damage to a medium when mediums of different sizes are mixed on the medium receiving tray.

According to a first aspect of the invention, there is provided a recording apparatus including a recording unit that records on a medium, a discharge unit that discharges the medium recorded by the recording unit, and a medium receiving tray that receives the medium discharged by the discharge unit, in which the medium receiving tray includes a pair of projecting sections provided on both side sections in a medium width direction, which is a direction intersecting a medium discharge direction, and a deformation restricting section which supports the medium between the pair of projecting sections and restricts a deformation of the medium supported by the pair of projecting sections.

According to the aspect, the medium receiving tray includes the projecting sections which extend from the upstream side toward the downstream side in the medium discharge direction at both end sections thereof in a medium width direction, which is a direction intersecting the medium discharge direction. As a result, the leading edge of a medium discharged from the discharge unit is received at a position closer to the discharge unit than a mounting surface of the medium receiving tray by the projecting sections, and a medium which tends to curl can appropriately be mounted on the medium receiving tray.

Further, the medium receiving tray includes the deformation restricting section which supports a medium between the pair of projecting sections and restricts the deformation of the medium supported by the pair of projecting sections. Accordingly, for example, when a medium having a width larger than a disposition interval of the pair of projecting sections is previously discharged to the medium receiving tray, and a medium having a width smaller than the disposition interval of the pair of projecting sections is stacked on the previously discharged medium, it is possible to suppress a possible damage, such as bending or scratching, to the medium having the large width between the pair of projecting sections, due to the weight of the medium having the small width. As described above, both of appropriate mounting of a medium in which the leading edge thereof is curled, and suppression or reduction of a possible damage to a medium when mediums of different sizes are mixed can be achieved in the medium receiving tray.

In the recording apparatus according to a second aspect of the invention, in a case where a first size medium is discharged by the discharge unit, the both end sides of the first size medium in the medium width direction are supported by the pair of projecting sections. In a case where a second size medium in which the size in the medium width direction thereof is small compared with that of the first size medium is discharged by the discharge unit, the both end sides of the second size medium in the medium width direction are supported between the pair of projecting sections.

According to the aspect, when mediums are mixed such that the first size medium, in which the size in the medium width direction is larger than the disposition interval of the pair of projecting sections, is previously stacked on the medium receiving tray, and the second size medium, in which the size in the medium width direction is smaller than the disposition interval of the pair of projecting sections, is stacked on the first size medium, it is possible to suppress or reduce a possible damage to the first size medium due to the weight of the second size medium.

In the recording apparatus according to a third aspect of the invention, the deformation restricting section includes a first supporting surface, which is located at a center between the pair of projecting sections in the medium width direction, and a second supporting surface, which extends from the projecting sections toward the first supporting surface.

According to the aspect, the deformation restricting section includes the first supporting surface, which is located at the center between the pair of projecting sections in the medium width direction, and the second supporting surface, which extends from the projecting sections toward the first supporting surface. Accordingly, it is possible to effectively suppress a possible damage, such as bending or scratching, to paper, between the pair of projecting sections.

In the recording apparatus according to a fourth aspect of the invention, the medium receiving tray includes a first receiving section that receives a medium, and a second receiving section that includes the pair of projecting sections and receives the medium at a position closer to the discharge unit than the first receiving section. The second receiving section is disposed symmetrically with respect to a center in the medium width direction, and outer side edges thereof in the medium width direction extend from an upstream side toward a downstream side in a medium discharge direction and toward the center.

According to the aspect, the second receiving section that includes the projecting sections and receives the medium at the position closer to the discharge unit than the first receiving section is disposed symmetrically with respect to the center in the medium width direction, and is configured such that the outer side edges of the second receiving section in the medium width direction extend from the upstream side toward the downstream side in the medium discharge direction and toward the center section. Accordingly, it is possible to reduce a contact area of the medium in the medium receiving tray from the upstream side to the downstream side in the medium discharge direction, and then reduce the resistance in which the discharged medium receives. As a result, it is possible to reduce a possibility that the medium is caught on the medium receiving tray, and discharge the medium smoothly.

In the recording apparatus according to a fifth aspect of the invention, the first receiving section has a shape in which an upward inclination angle thereof becomes steep from an upstream side toward a downstream side in a medium discharge direction.

According to the aspect, the first receiving section has the shape in which the upward inclination angle thereof becomes steep from the upstream side toward the downstream side in the medium discharge direction. Accordingly, a position of the end section on the lower side in the inclined direction of the medium, mounted on the medium receiving tray, can easily be aligned to the upstream side in the medium discharge direction using the weight of the medium.

In the recording apparatus according to a sixth aspect of the invention, the second receiving section is provided to be switchable between a first state and a second state which projects from the first receiving section compared with the first state.

According to the aspect, the second receiving section can be switched between the first state and the second state, which projects from the first receiving section compared with the first state. In a case of a medium in which the curl is likely to occur at the leading edge thereof (for example, medium transported in the grain-short in which the paper grain intersects with a medium transport direction), the second receiving section is set to the second state, which projects from the first receiving section compared with the first state, to receive the medium at a position closer to the discharge unit. As a result, the medium which tends to curl can appropriately be mounted on the medium receiving tray. On the other hand, in a case where a medium in which the curl is unlikely to occur at the leading edge of the medium (for example, medium transported in the grain-long in which the paper grain is along the medium transport direction) is received on the medium receiving tray, when the second receiving section is set to the first state, which less projects from the first receiving section compared with the second state. As a result, it is possible to increase the stacking allowable number on the medium receiving tray.

In the recording apparatus according to a seventh aspect of the invention, the second receiving section projects from the first receiving section in the first state.

According to the aspect, the second receiving section projects from the first receiving section in the first state. Accordingly, even when the second receiving section is in either the first state or the second state, it is possible to be configured such that the second receiving section receives a medium at the higher position than the first receiving section.

In the recording apparatus according to an eighth aspect of the invention, the recording apparatus further includes a switching unit that switches states of the second receiving section, and a control unit that controls the switching unit. The control unit controls the switching unit based on driver information.

According to the aspect, the control unit can perform the switching of the states of the second receiving section by the switching unit based on the driver information.

In the recording apparatus according to a ninth aspect of the invention, a recessed section is formed on an end section, of the medium receiving tray, on a downstream side in a medium discharge direction, and an operating section for switching the states of the second receiving section is disposed on the recessed section.

According to the aspect, the operating section for switching the states of the second receiving section is disposed on the recessed section, formed on the end section, of the medium receiving tray, on the downstream side in the medium discharge direction. Accordingly, the operating section can be disposed in a space-saving manner.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

An outline of a recording apparatus according to an embodiment of the invention will be described. In the embodiment, an ink jet printer 1 (hereinafter simply referred to as printer 1) is exemplified as an example of the recording apparatus.

Figure 1:
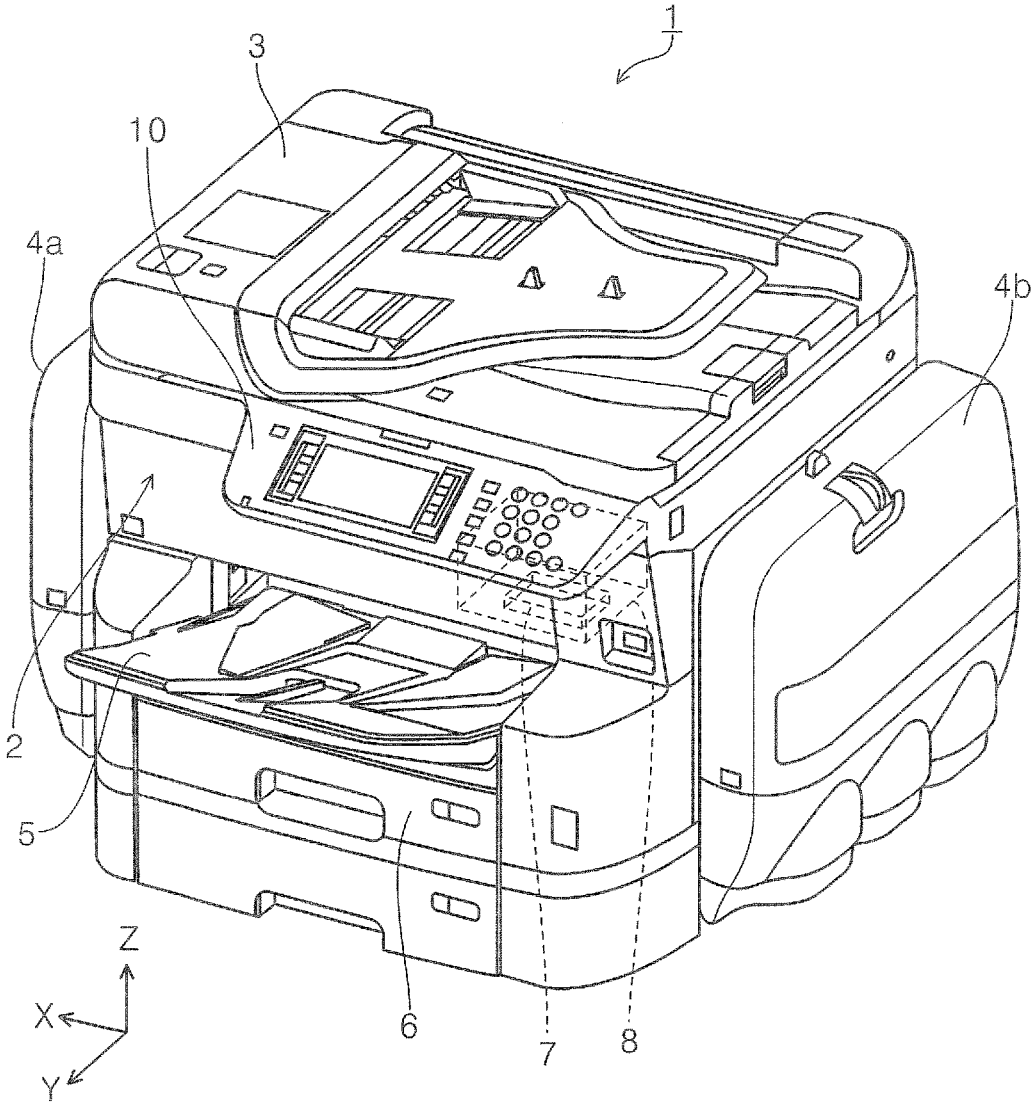
FIG. 1 is an external perspective view illustrating a printer according to a first embodiment.
Figure 2:
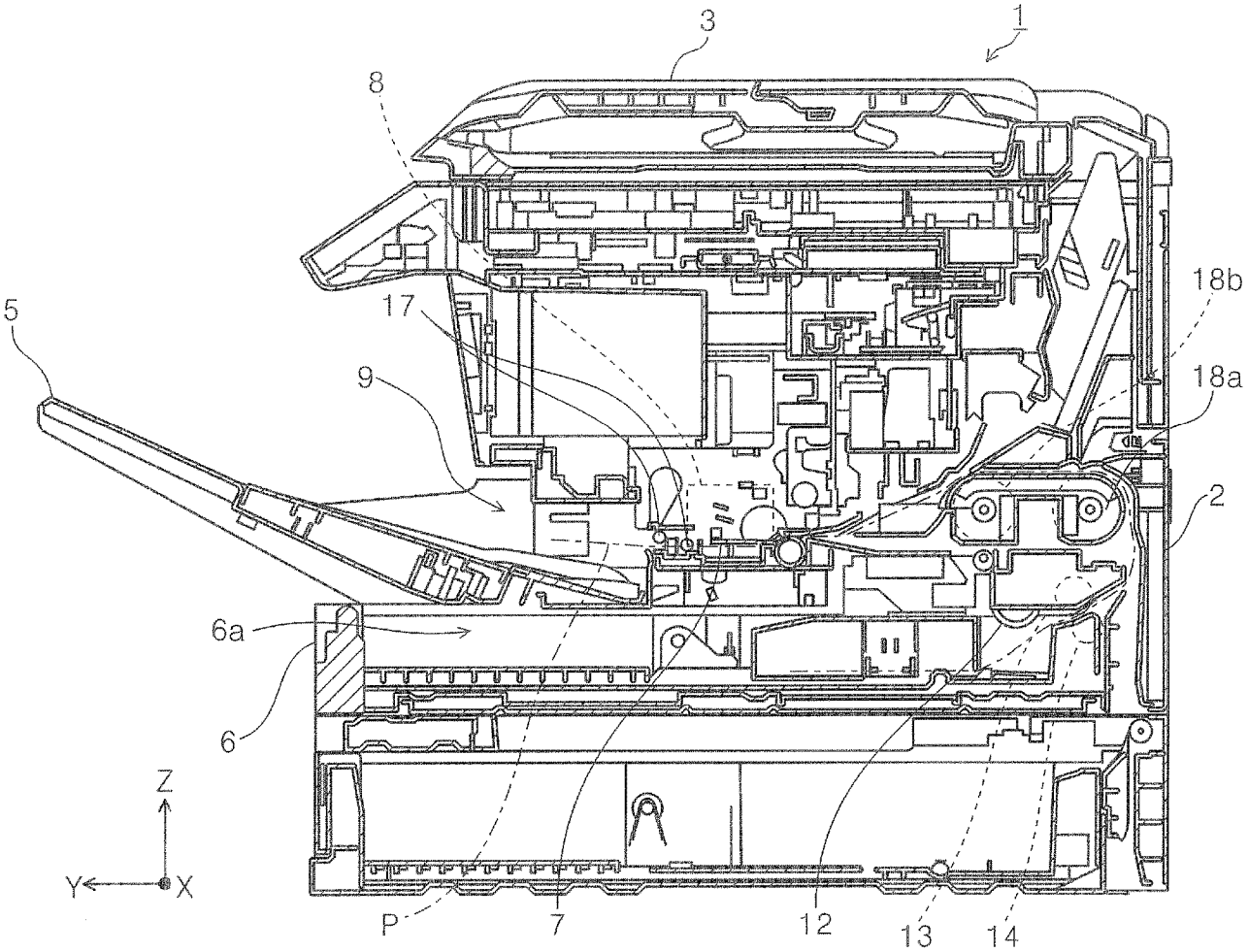
FIG. 2 is a sectional side view of the printer illustrated in FIG. 1.
Figure 3:
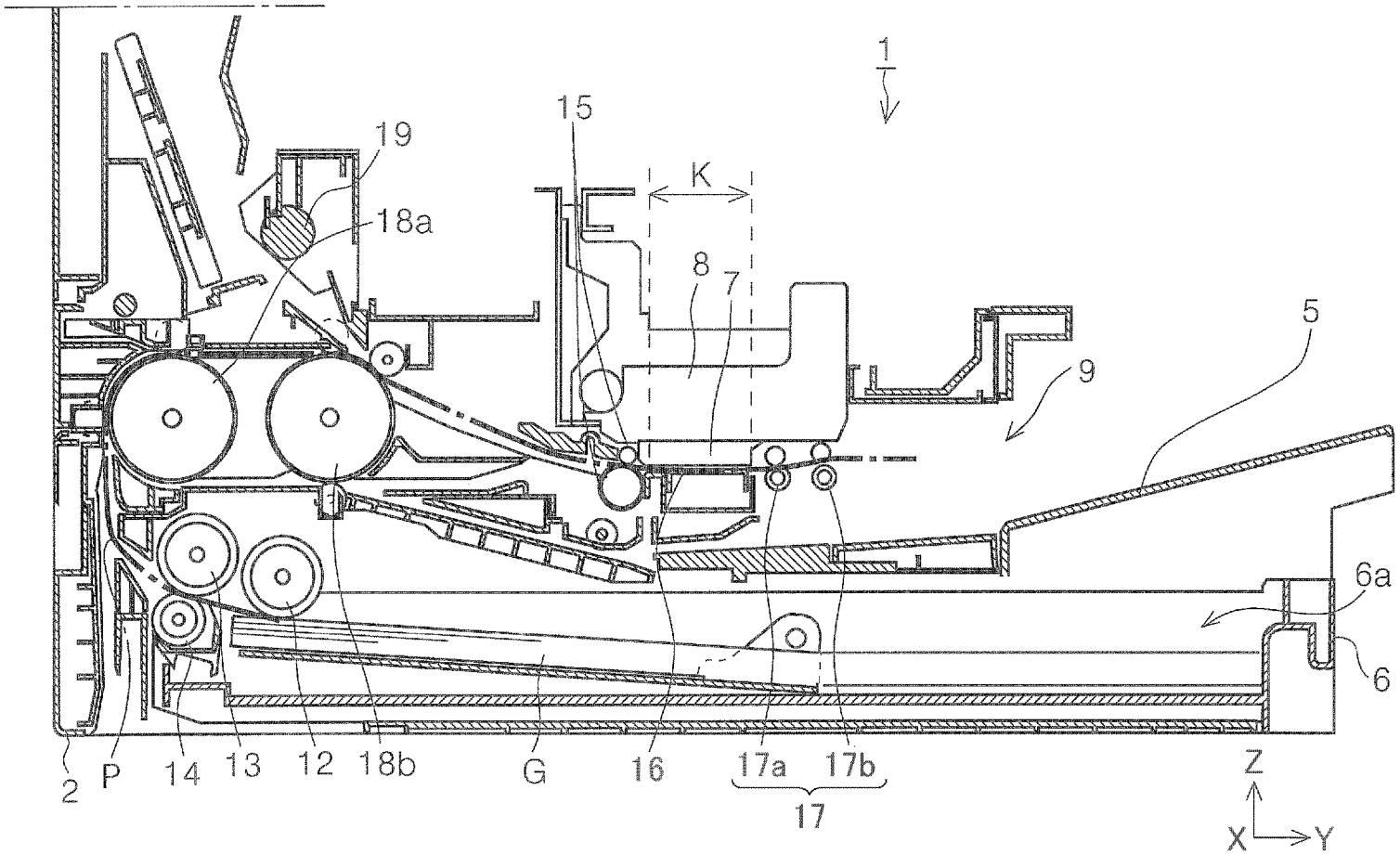
FIG. 3 is a sectional side view illustrating a paper transport path of the printer.
Figure 4:
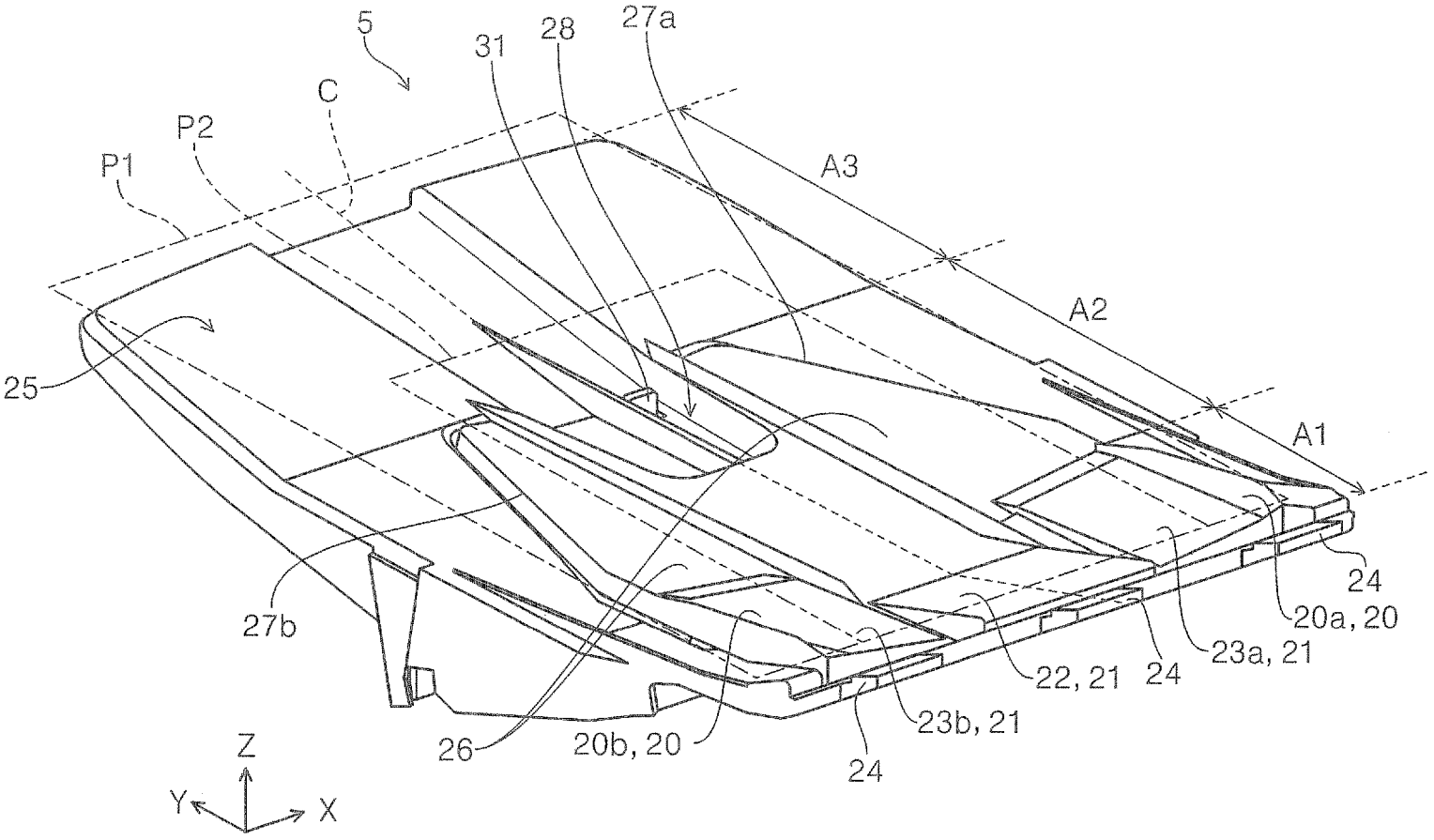
FIG. 4 is an external perspective view of a paper discharge tray and is a view in which a second receiving section is in a first state.
Figure 5:
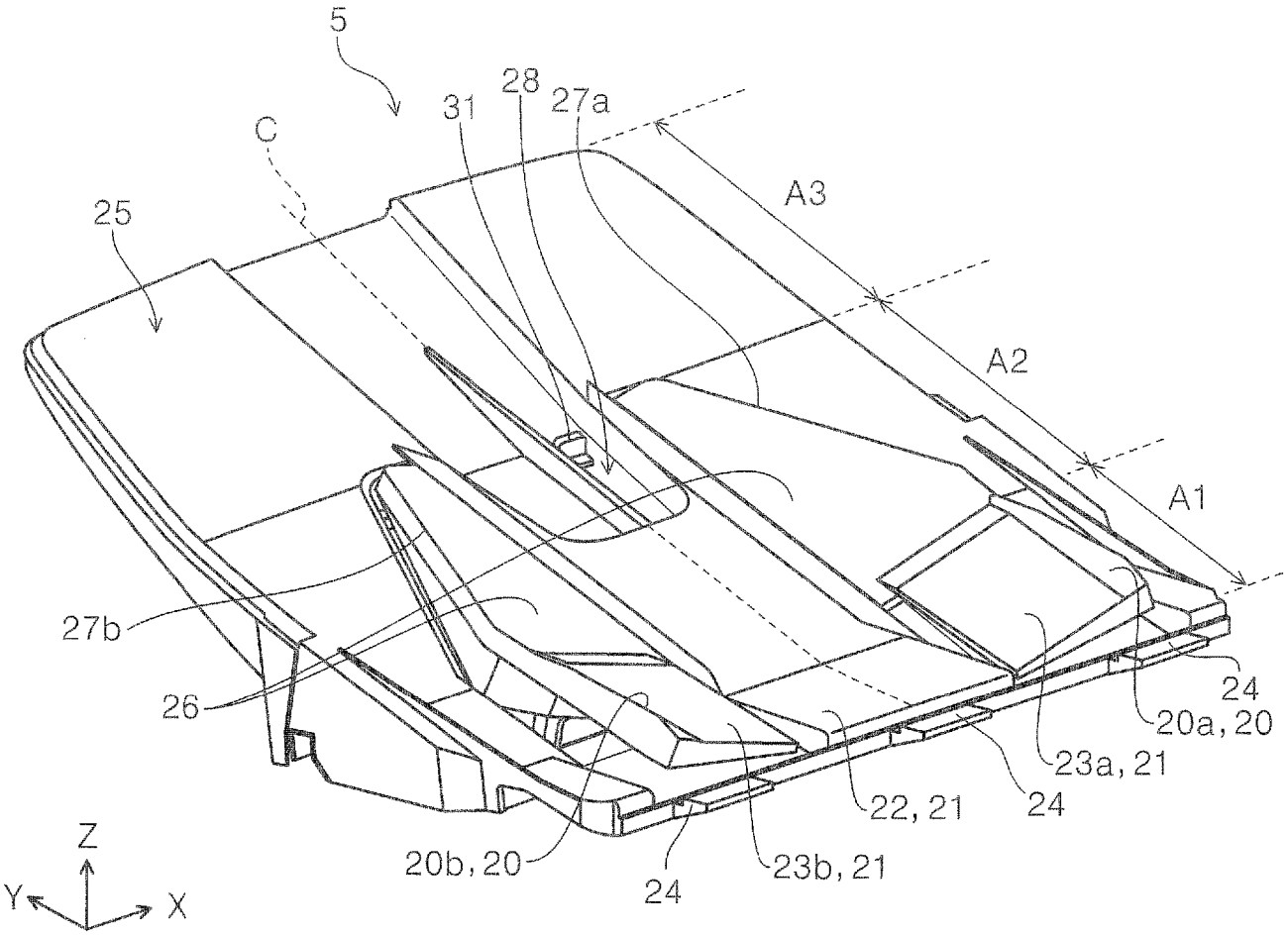
FIG. 5 is an external perspective view of the paper discharge tray and is a view in which the second receiving section is in a second state.
Figure 6:
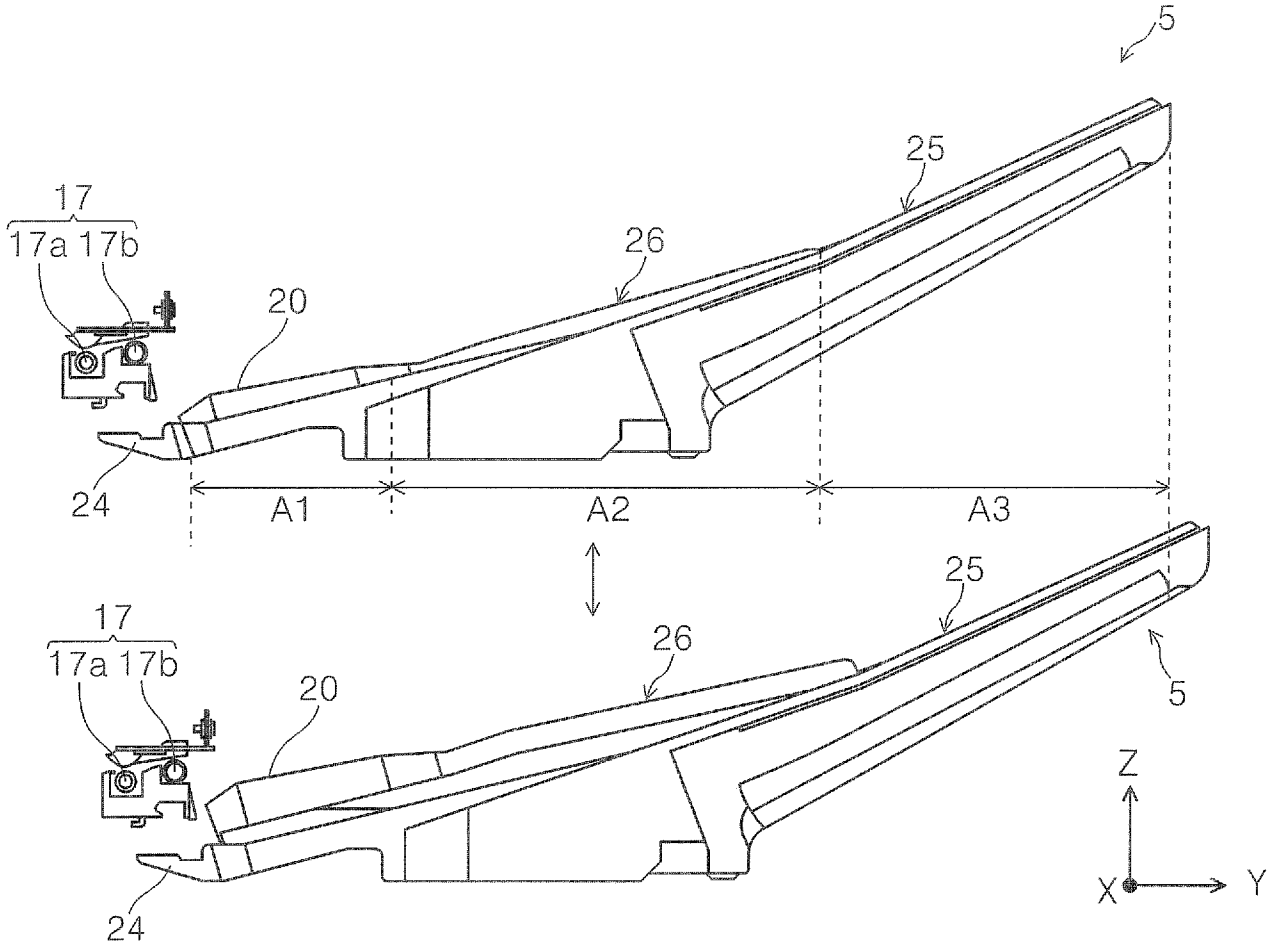
FIG. 6 is a side view of the paper discharge tray and is a view illustrating a change in the first state and the second state of the second receiving section.
Figure 7:
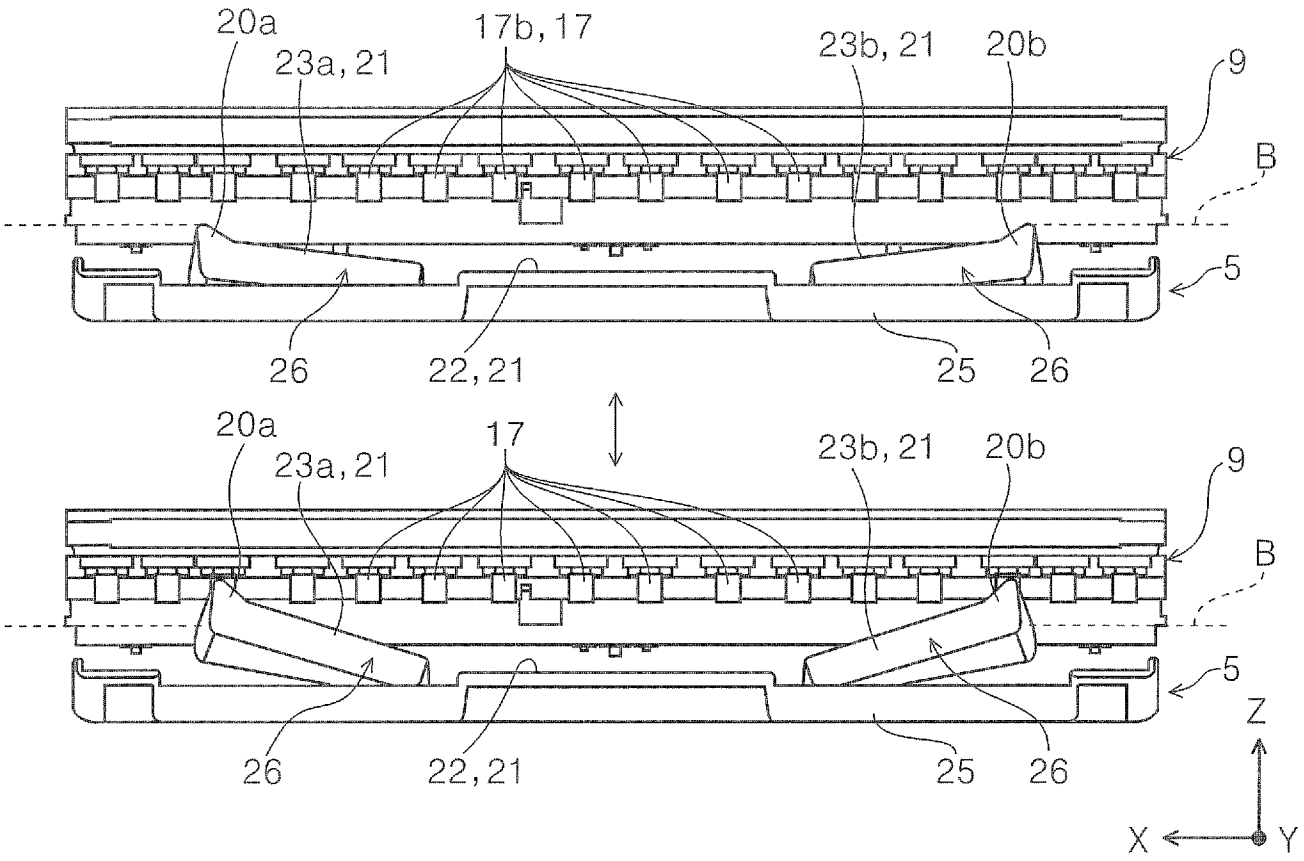
FIG. 7 is a front view of the paper discharge tray and is a view illustrating the change in the first state and the second state of the second receiving section.
Figure 8:
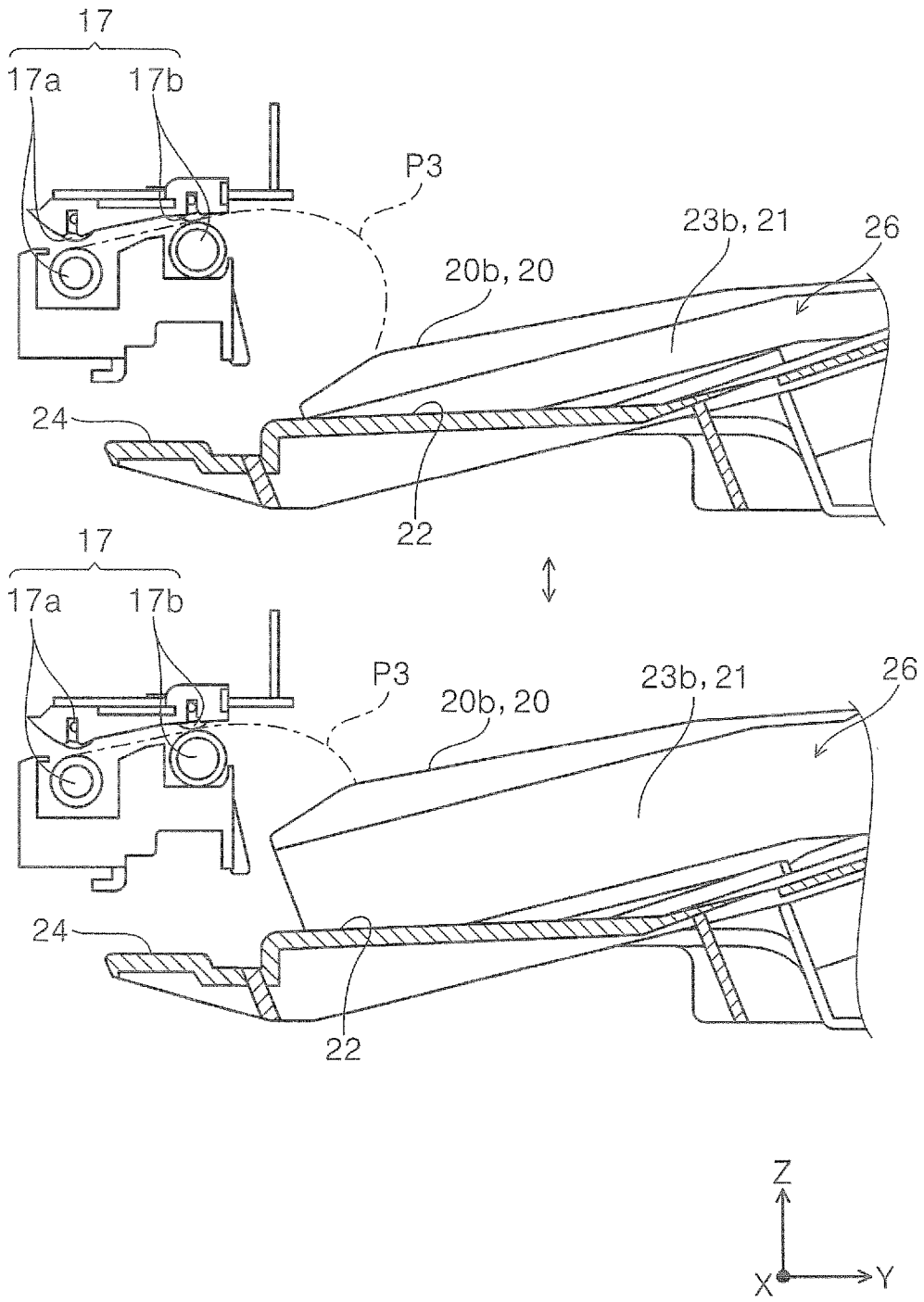
FIG. 8 is an enlarged view of the main section in a sectional side view of the paper discharge tray and is a view illustrating the change in the first state and the second state of the second receiving section.
Figure 9:
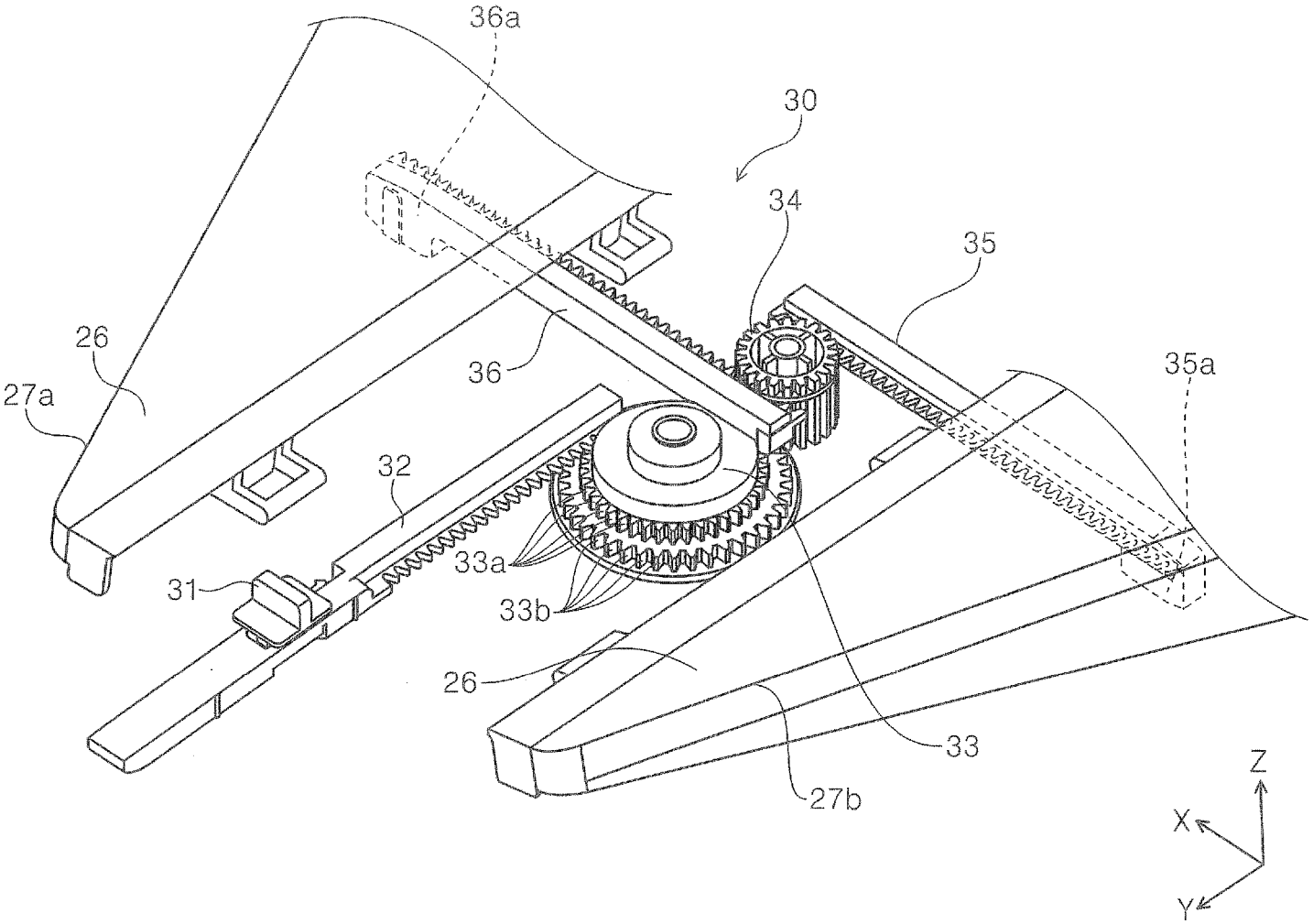
FIG. 9 is a perspective view illustrating a switching unit that switches the states of the second receiving section.
Figure 10:
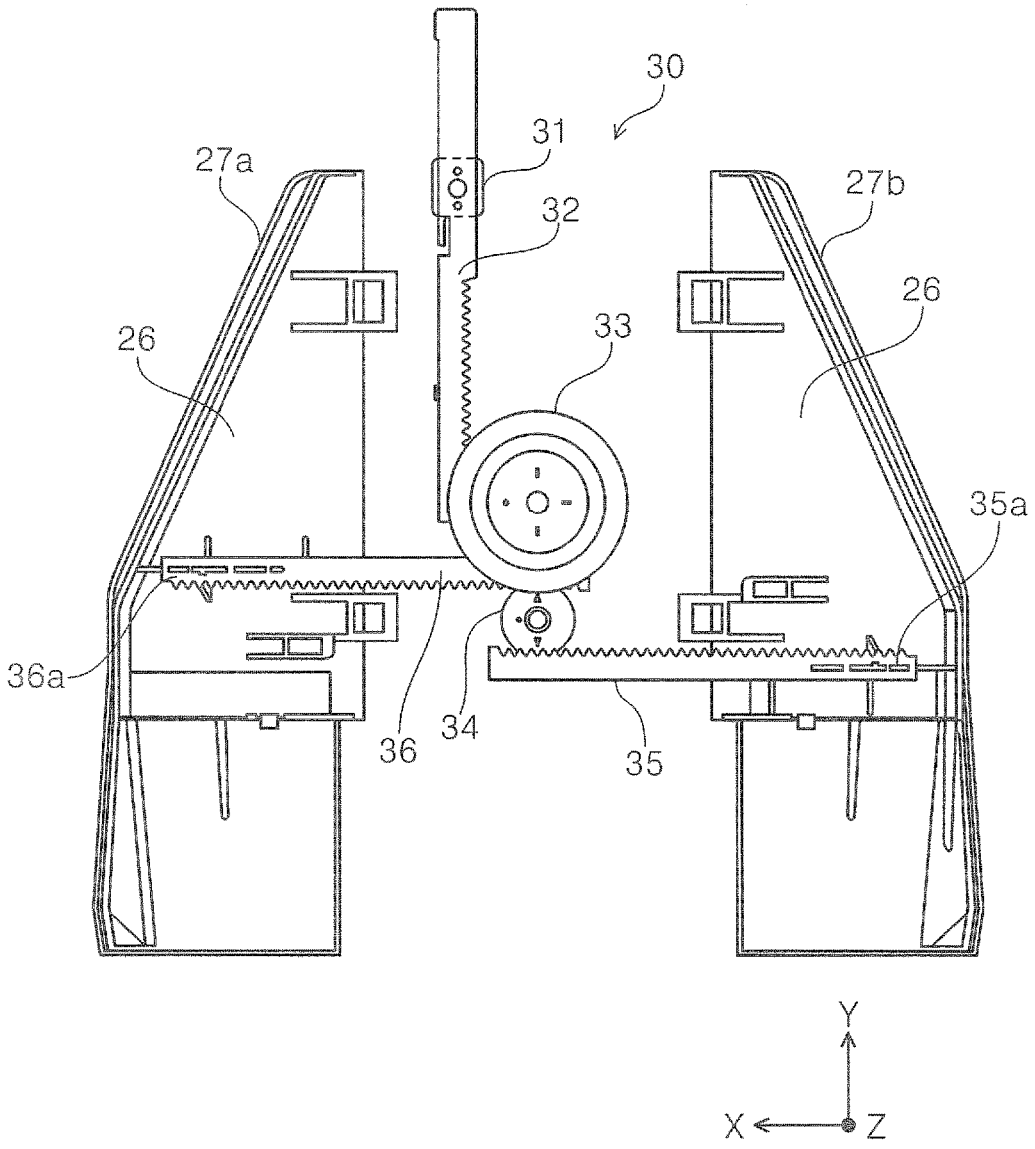
FIG. 10 is a view of the switching unit illustrated in FIG. 9 as viewed from the lower surface side.
Figure 11:
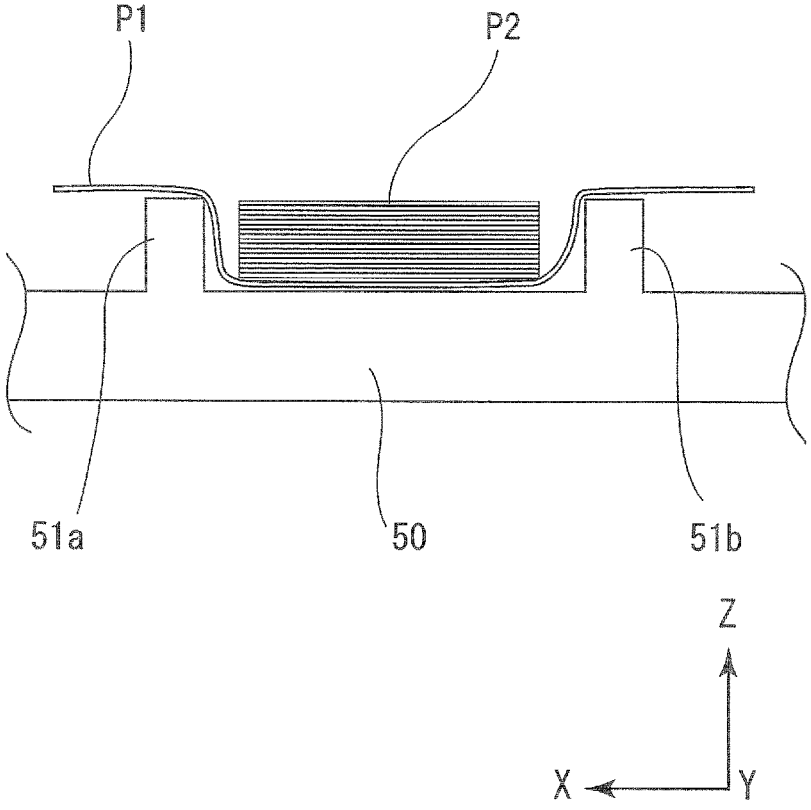
FIG. 11 is a view illustrating a state that pieces of paper of different sizes are mixed on a paper discharge tray of the related art.

FIG. 1 is an external perspective view illustrating a printer according to a first embodiment. FIG. 2 is a sectional side view of the printer illustrated in FIG. 1. FIG. 3 is a sectional side view illustrating a paper transport path of the printer. FIG. 4 is an external perspective view of a paper discharge tray and is a view in which a second receiving section is in a first state. FIG. 5 is an external perspective view of the paper discharge tray and is a view in which the second receiving section is in a second state. FIG. 6 is a side view of the paper discharge tray and is a view illustrating a change in the first state and the second state of the second receiving section. FIG. 7 is a front view of the paper discharge tray and is a view illustrating the change in the first state and the second state of the second receiving section. FIG. 8 is an enlarged view of the main section in a sectional side view of the paper discharge tray and is a view illustrating the change in the first state and the second state of the second receiving section. FIG. 9 is a perspective view illustrating a switching unit that switches the states of the second receiving section. FIG. 10 is a view of the switching unit illustrated in FIG. 9 as viewed from the lower surface side. FIG. 11 is a view illustrating a state that pieces of paper of different sizes are mixed on a paper discharge tray of the related art.

In X-Y-Z coordinate system illustrated in each view, the X-axis direction illustrates the width direction of the recording apparatus and a moving direction of a recording head, the Y-axis direction illustrates the depth direction of the recording apparatus, and the Z-axis direction illustrates the height direction of the apparatus. In each view, the +X-axis direction side is the left side of the apparatus, the −X-axis direction side is the right side of the apparatus, the +Y-axis direction side is the front side of the apparatus, the −Y-axis direction side is the back side of the apparatus, the +Z-axis direction side is the upper side of the apparatus, and the −Z-axis direction side is the lower side of the apparatus. A direction that paper is being transported in a printer is referred to as "downstream" and the opposite direction thereof is referred to as "upstream".

Overall Configuration of the Printer

Hereinafter, the overall configuration of the printer 1 will be described mainly with reference to FIG. 1.

The printer 1 (FIG. 1) according to the invention is configured, as a compound machine, to include an apparatus main body 2 including a recording head 7 as a "recording unit" that ink is ejected to paper as a "medium" and recording is performed, a scanner section 3 provided on the upper section of the apparatus main body 2, that is, include a scanner function in addition to a recording function.

The outer side of the apparatus main body 2 includes ink container housing cases 4*a*, 4*b* that house ink containers (not illustrated) for containing ink supplied to the recording head 7.

A reference numeral 10 in the front surface of the apparatus denotes an operating panel 10 including operating buttons for performing various reading setting/reading execution and a display section for displaying contents of the reading setting.

The recording head 7 is disposed on a carriage 8 configured to be movable in the X-axis direction in FIG. 1 within the apparatus main body 2 and is configured to eject ink to paper transported to a recording area K (FIG. 3) facing the recording head 7 in order to perform recording.

Paper Transport Path of the Printer

A paper transport path P in the printer 1 will be described mainly with reference to FIG. 3. Referring to FIG. 3, a paper feeding cassette 6 (refer to FIGS. 1 and 2) capable of containing a plurality of pieces of paper in a container section 6*a* is provided on the lower section of the apparatus main body 2. The long side of the paper contained in the container section 6*a* is set in the Y-axis direction along the paper transport direction in the container section 6*a*.

The paper on the uppermost of the plurality of pieces of paper (paper bundle G), set in the paper feeding cassette 6, is picked up by a first feed roller 12 (also referred to as pick-up roller) from the paper feeding cassette 6, is nipped by a transport driving roller 13, which is rotationally driven by a driving source (not illustrated) to transport the paper, and a separating roller 14, which is driven and rotated by the transport driving roller 13, and then, is transported to the downstream side of the transport path.

The transport path P is formed along a roller surface of a transport driving roller 18*a* in a bent manner. The paper transported to the back side (−Y direction) of the apparatus temporarily from the paper feeding cassette 6 is transported to the front side (+Y direction) of the apparatus by the transport driving roller 18*a* and a transport driving roller 18*b*.

A pair of transport rollers 15 is provided on the downstream side of the transport driving roller 18*b* and the upstream side (the back side of the apparatus, −Y direction) of the recording head 7, and the paper is transported under the recording head 7 by the pair of transport rollers 15.

The paper transported to the front side of the apparatus passes through the lower side of the recording head 7 while being supported by a supporting member 16 provided to face the recording head 7, and recording is performed on the paper by ink ejected from the recording head 7.

A pair of first discharge rollers 17*a* and a pair of second discharge rollers 17*b*, as a discharge unit 17 that discharges the paper recorded by the recording head 7, is provided on the downstream side (the front side of the apparatus, +Y direction) of the recording head 7. A paper discharge tray 5, as a "medium receiving tray" for receiving the paper discharged by the discharge unit 17, is provided on the front side of the apparatus of the apparatus main body 2.

The paper after recording by the recording head 7 is nipped by the discharge unit 17 and discharged to the paper discharge tray 5. Next, the paper discharge tray 5 for receiving the paper discharged by the discharge unit 17 will further be described.

Paper Discharge Tray

Projecting Section and Deformation Restricting Section

The paper discharge tray 5 (FIG. 4) is configured to be detachable with respect to the apparatus main body 2. In FIG. 4, a reference numeral 24 denotes an engaging section 24 capable of being engaged with an engaged section (not illustrated) of the side of the apparatus main body 2, and the paper discharge tray 5 can take a state of being attached to the apparatus main body 2, as illustrated in FIGS. 1 and 2, and a state of being detached, as illustrated in FIG. 4. The paper discharge tray 5 in the embodiment is configured such that recordable paper of a maximum size is mounted on the paper discharge tray 5 alone in the printer 1, and for example, does not include such as an extension tray, which slides in the Y-axis direction. Although the paper discharge tray 5 is large in size, the printer can compactly be packed, for example, by detaching the paper discharge tray 5 from the apparatus main body 2 when packing the printer as a product.

The paper discharge tray 5 (FIG. 4) includes a pair of projecting sections 20 (projecting section 20*a* and projecting section 20*b*), which extends from the upstream side toward the downstream side in the paper discharge direction, that is, in the +Y direction, and a deformation restricting section 21 which supports paper between the projecting section 20*a* and the projecting section 20*b*, and restricts the deformation of the paper supported by the projecting section 20*a* and the projecting section 20*b*, at both end sections in a paper width direction (X-axis direction), which is a direction intersecting a paper discharge direction (+Y-axis direction) as a "medium discharge direction". The state of projection of the projecting section 20 is clearly illustrated in FIG. 7.

The deformation restricting section 21 (FIG. 4), more specifically, is configured to include a first supporting surface 22, which is located at the center between a projecting section 20*a* and a projecting section 20*b* in the paper width direction, and a second supporting surface 23*a* and a second supporting surface 23*b*, which extend from each of the projecting section 20*a* and the projecting section 20*b* toward the first supporting surface 22.

In the embodiment, the paper discharge tray 5 includes a first receiving section 25 that receives paper, the projecting section 20 (projecting section 20*a* and projecting section 20*b*), and a second receiving section 26 that receives paper at a higher position than the first receiving section 25. The second receiving section 26 is disposed symmetrically with respect to a center section C (FIG. 4) in the paper width direction, and is formed such that the outer side edges 27*a*, 27*b* thereof in the paper width direction extend from the upstream side toward the downstream side in the paper discharge direction and toward the center section C. In other words, the second receiving section 26 is formed such that the outer side edges 27*a*, 27*b* of the second receiving section connecting to the second supporting surfaces 23*a*, 23*b* are in a tapered shape toward the +Y-axis direction.

When the projecting section 20 is provided on the paper discharge tray 5, the leading edge of paper discharged from the discharge unit 17 can be received at a position closer to the discharge unit 17 than a mounting surface of the paper discharge tray 5 without the projecting section 20. Accordingly, a curled paper can appropriately be mounted on the paper discharge tray 5.

On the other hand, although a paper discharge tray 50 in related art illustrated in FIG. 11 includes a projecting section 51*a* and a projecting section 51*b* corresponding to the projecting section 20*a* and the projecting section 20*b*, when the deformation restricting section 21 is not provided thereon, there is a case where paper (first size medium P1) having a width larger than a disposition interval of the projecting section 51*a* and the projecting section 51*b* is bent between the projecting section 51*a* and the projecting section 51*b*. In particular, as illustrated in FIG. 11, in a case where paper (for example, first size medium P1) having a width larger than the disposition interval of the projecting section 51*a* and the projecting section 51*b* is previously discharged to the paper discharge tray 5, and pieces of paper (for example, second size medium P2) having a width smaller than the disposition interval of the projecting section 51*a* and the projecting section 51*b* are stacked (mixed) on the previously discharged paper, the second size mediums P2 are dropped between the projecting section 51*a* and the projecting section 51*b*. There is a possibility that the first size medium P1 is bent between the projecting section 51*a* and the projecting section 51*b* due to the weight of the second size mediums P2. However, in the paper discharge tray 5 of the embodiment, such deformation is effectively suppressed by the deformation restricting section 21.

As described above, both of appropriate mounting of paper in which the leading edge thereof tends to curl, and suppression or reduction of a possible damage to a medium when mediums of different sizes are mixed can be achieved by the paper discharge tray 5, including the projecting section 20*a* and the projecting section 20*b*, and the deformation restricting section 21, which is provided therebetween. The deformation restricting section 21 is configured by the first supporting surface 22 and the second supporting surfaces 23*a*, 23*b* to reduce the level difference between the projecting section 20*a* and the projecting section 20*b*. Accordingly, bending or scratching of paper by the projecting section 20*a* and the projecting section 20*b* can be suppressed or avoided.

Further, the paper discharge tray 5 includes the projecting section 20, and the second receiving section 26, which receives paper at higher position than the first receiving section 25, is symmetrically disposed with respect to the center section C in the paper width direction and is formed such that the outer side edges 27*a*, 27*b* of the second receiving section extend toward the center section C, that is, in a tapered shape toward the +Y-axis direction. Accordingly, it is possible to reduce a contact area of paper toward the paper discharge direction (+Y-axis direction) in the paper discharge tray 5, and then reduce the contact resistance between the discharged paper and the paper discharge tray 5.

As a result, it is possible to reduce a possibility that paper is caught on the paper discharge tray 5, and discharge the paper smoothly.

In FIG. 4, the projecting section 20*a* and the projecting section 20*b* in the paper discharge tray 5 are disposed such that the both projecting sections are located at the inner side of the A3 size paper width as the "first size medium P1", that is, the short side of the A3 size. The projecting section 20*a* and the projecting section 20*b* in the paper discharge tray 5 are disposed such that the both projecting sections are located at the outer side of the A4 size paper width, as the "second size medium P2", that is, the short side of the A4 size.

In other words, on the A3 size paper as the "first size medium P1" used in the printer 1, the size in the paper width direction is larger than the disposition interval between the projecting section 20*a* and the projecting section 20*b*. In the A4 size paper as the "second size medium P2", the size in the paper width direction is smaller than the disposition interval between the projecting section 20*a* and the projecting section 20*b*.

That is, in a case where the A3 size paper (first size medium P1) is discharged by the discharge unit 17, both end sides of the A3 size paper in the paper width direction are supported by the projecting section 20*a* and the projecting section 20*b*. In a case where the A4 size paper (second size medium P2), in which the size in the paper width direction thereof is small compared with that of the A3 size paper is discharged by the discharge unit 17, both end sides in the paper width direction in the A4 size paper are supported by the deformation restricting section 21 between the projecting section 20*a* and the projecting section 20*b*.

Such relationship between the disposition interval between the projecting section 20*a* and the projecting section 20*b*, and the first size medium P1 (A3 size) and the second size medium P2 (A4 size) used in the printer 1 is set. Accordingly, when mediums are mixed such that the first size medium P1 (A3 size) is previously stacked on the paper discharge tray 5 and the second size medium P2 (A4 size) is stacked on the previously stacked medium, it is possible to suppress or reduce a possible damage to the first size medium P1 (A3 size) due to the weight of the second size medium P2 (A4 size).

First Receiving Section

The first receiving section 25 in the paper discharge tray 5, as illustrated in FIG. 6, has a shape in which an upward inclination angle thereof becomes steep from the upstream side toward the downstream side in the paper discharge direction.

The first receiving section 25, more specifically, is formed to include three-step inclination of an area A1 close to the discharge unit 17, an area A2 which is provided on the downstream side (+Y-axis direction side) in the paper discharge direction of the area A1 and is formed with a steeper angle than the area A1, and an area A3 which is provided on the downstream side in the paper discharge direction of the area A2 and is formed with a further steeper angle than the area A2 (refer to FIGS. 6 and 4).

Since the first receiving section 25 has a shape in which an upward inclination angle thereof becomes steep toward the paper discharge direction (+Y-axis direction), a position of the end section on the lower side in the inclined direction of paper, mounted on the paper discharge tray 5, can easily be aligned to the upstream side in the paper discharge direction (−Y-axis direction side) using the weight of the paper.

Second Receiving Section

The second receiving section 26 is configured to be switchable between the first state, as illustrated in FIG. 4 and in the upper views in each of FIGS. 6 to 8, and the second state which projects from the first receiving section 25 compared with the first state, as illustrated in FIG. 5 and in the lower views in each of FIGS. 6 to 8.

The second receiving section 26 is switchable between the first state (upper view in FIG. 8) and the second state (lower view in FIG. 8) to obtain the following operation effects.

As in the embodiment, in a case where liquid (ink) is ejected from the upper side of paper and the paper is discharged in the face up state, in which the liquid-ejected surface faces upward, when the paper is, for example, grain-short in which paper grain intersects with the paper transport direction, the curl at the leading edge of the paper is likely to occur. Such paper is set as a paper P3 (FIG. 8). In a case of the paper P3, which tends to curl at the leading edge thereof, with the height B (refer to the upper view in FIG. 7) of the projecting section 20 in the first state, the leading edge of the paper P3 may be rounded when the paper is landed on the projecting section 20, as illustrated in the upper view in FIG. 8.

In a case where the paper P3, which tends to curl at the leading edge thereof, is received on the paper discharge tray 5, when the second receiving section 26 is set to the second state (lower views in FIGS. 7 and 8) which projects from the first receiving section 25 compared with the first state, it is possible to land the leading edge of the paper P3 on the projecting section 20 at a position closer to the discharge unit 17, as illustrated in the lower view in FIG. 8, and appropriately mount the paper P3 on the paper discharge tray 5.

In the embodiment, the A3 size paper (first size medium P1) is configured such that the direction of the flowing grain of the paper is along the short side of the paper, and the long side of the paper is transported in a direction along the paper transport direction. That is, the A3 size paper is transported in the grain-short. The A3 size paper, which tends to curl due to the transport in the grain-short, can be received on the projecting section 20 at a position closer to the discharge unit 17 than the mounting surface of the paper discharge tray 5, and appropriately mounted on the tray.

On the other hand, in a case where paper in which the curl at the leading edge of the paper is unlikely to occur (for example, paper transported in the grain-long in which the paper grain is along the paper transport direction) is received on the paper discharge tray 5, when the second receiving section 26 is set to the first state (the upper view in FIG. 8), which is less projected from the first receiving section 25 compared with the second state, it is possible to increase the stacking allowable number on the paper discharge tray 5. Even when the second receiving section 26 is set to the first state, in a case where the "first size medium P1", in which the paper width is wider than the interval between the projecting section 20*a* and the projecting section 20*b*, is transported in the grain-long (for example, in a case where the direction of the flowing grain of the A3 size paper is along the long side of the paper and the long side of the paper is transported in a direction along the paper transport direction, or in a case where the direction of the flowing grain of the A4 size paper is along the short side of the paper and the short side of the paper is transported in a direction along the paper transport direction), the paper is received by the projecting section 20*a* and the projecting section 20*b*.

In the paper discharge tray 5 according to the embodiment, the second receiving section 26 projects from the first receiving section 25 in the first state (the upper view in FIG. 7).

In the embodiment, since the interval between the projecting section 20*a* and the projecting section 20*b* is wider than the width size of the second size medium P2 (A4 size in the embodiment), in a case where the paper of a size having equal to or less than the second size medium P2 (A4 size in the embodiment) curls, the leading edge of the paper cannot be landed on the projecting section 20*a* and the projecting section 20*b*. However, in the curl of paper of relatively small size, which is the A4 size, or equal to or less than the size, the growth rate of the curl associated with the paper transport is slower than that of the first size medium P1 (A3 size in the embodiment). Accordingly, even at the lower position (position away from the discharge unit 17) than the projecting section 20*a* and the projecting section 20*b* that prevents the curl of the first size medium P1, it is possible to suppress the curl at the leading edge of the paper and land the paper. Since the second receiving section 26 projects from the first receiving section 25 in the first state, as illustrated in the upper view in FIG. 7, even when the second receiving section 26 is in either the first state or the second state, it is possible to be configured such that the second receiving section 26 receives the medium at the higher position than the first receiving section 25. This makes it easy to prevent the curl of the second size medium P2 (A4 size in the embodiment), in which the width size thereof is narrower than the interval between the projecting section 20*a* and the projecting section 20*b*.

Switching Unit of Second Receiving Section

Next, the switching unit 30 that switches between the first state and the second state of the second receiving section 26 will be described with reference to FIGS. 9 and 10.

The switching unit 30 (FIGS. 9 and 10) includes an operating section 31 and is configured to include a first rack member 32 that meshes with an upper gear 33*a* of a first pinion gear 33 described below, the first pinion gear 33 including the upper gear 33*a* and a lower gear 33*b*, a second pinion gear 34 that meshes with the lower gear 33*b* of the first pinion gear 33, and a second rack member 35 and a third rack member 36 that meshes with the second pinion gear 34.

FIGS. 9 and 10 illustrate a state of the switching unit 30 when the second receiving section 26 becomes the second state. When the operating section 31, which is a knob section for operating the switching unit 30, is moved in the −Y-axis direction, the first rack member 32, in which the operating section 31 is integrally provided, is also moved in the −Y-axis direction. Accordingly, the first pinion gear 33, meshing with the first rack member 32 at the upper gear 33*a*, rotates in the clockwise direction in FIG. 9 and in the counter-clockwise direction in FIG. 10.

When the first pinion gear 33 rotates, the second pinion gear 34 that meshes with the lower gear 33*b* rotates in the counter-clockwise direction in FIG. 9 and in the clockwise direction in FIG. 10. Further, in the second rack member 35 and the third rack member 36 that mesh with the second pinion gear 34, the second rack member 35 moves in the +X-axis direction, and the third rack member 36 moves in the −X-axis direction.

The second rack member 35 and the third rack member 36 are respectively provided with a push-up section 35*a* and a push-up section 36*a* at the end sections opposite to sides engaged with the second pinion gear 34.

As in FIGS. 9 and 10, when the push-up section 35*a* and the push-up section 36*a* are located at the outer side of the second receiving section 26, the second receiving section 26 is pushed up by the push-up section 35*a* and the push-up section 36*a* to be in the second state. On the other hand, by moving the operating section 31 in the −Y-axis direction, the second rack member 35 moves in the +X-axis direction and the third rack member 36 moves in the −X-axis direction. Then, the push-up section 35*a* and the push-up section 36*a* are retracted inward of the second receiving section 26, and the second receiving section 26 becomes in the first state.

The switching unit 30 is provided on the rear surface (surface of the −Z-axis direction side) of the second receiving section 26.

A recessed section 28 is formed on the end section, of the paper discharge tray 5, on the downstream side in the paper discharge direction (FIGS. 4 and 5). In the recessed section 28, the operating section 31 for switching the states of the second receiving section 26 is disposed in an exposed manner. Since the operating section 31 for switching the states of the second receiving section 26 is disposed on the recessed section 28, the operating section 31 can be disposed in a space-saving manner.

Second Embodiment

Figure 12:
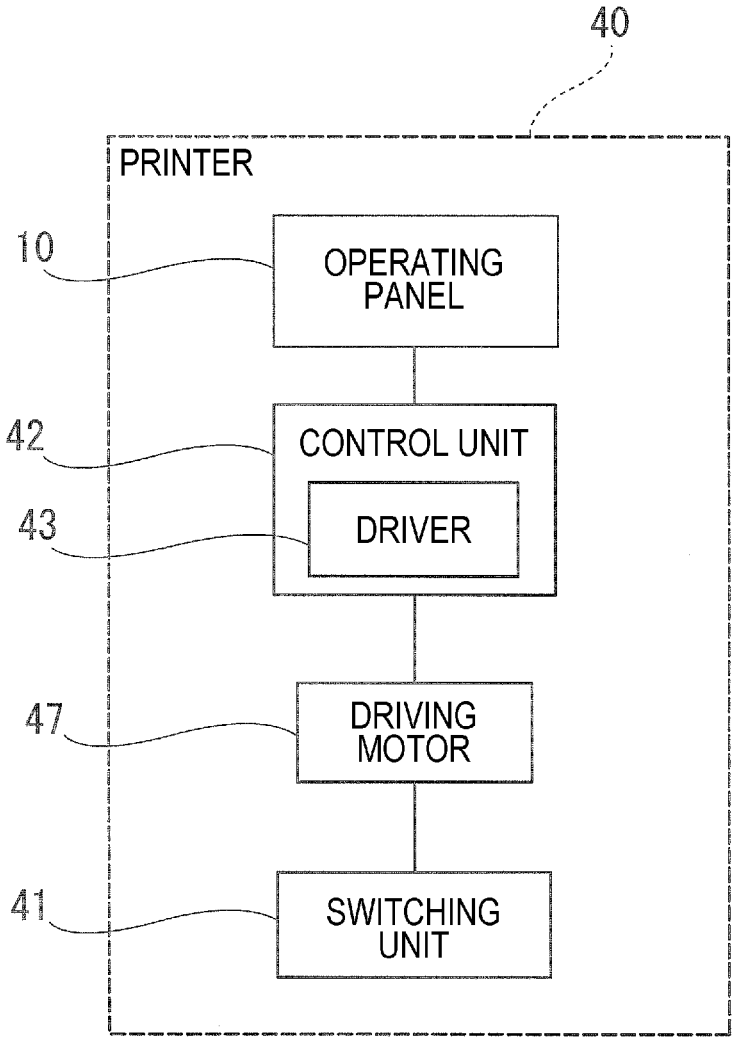
FIG. 12 is a block diagram illustrating a control system of the printer according to a second embodiment.

In the embodiment, the other example of the printer according to the invention will be described based on FIGS. 12 and 13. FIG. 12 is a block diagram illustrating a control system of the printer according to the second embodiment.

Figure 13:
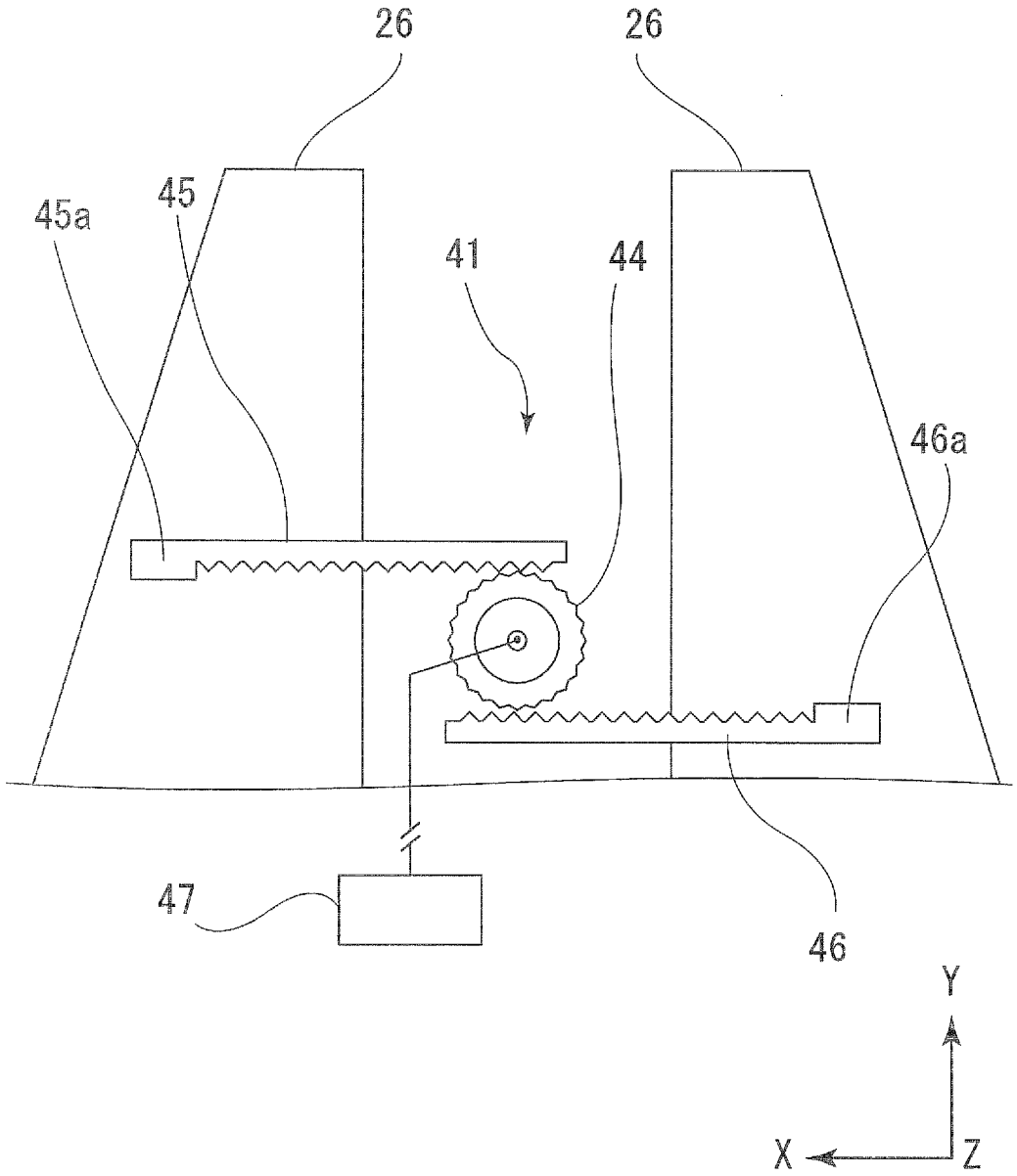
FIG. 13 is a view of a switching unit according to the second embodiment as viewed from the lower surface side.

FIG. 13 is a view of a switching unit according to the second embodiment as viewed from the lower surface side. In the embodiment, the same reference numerals are assigned to the same configuration as that of the first embodiment, and the description of the configuration is omitted.

In the first embodiment, the switching unit 30 that switches the states of the second receiving section 26 on the paper discharge tray 5 is manually operated so as to be switched. However, a printer 40 in the second embodiment is configured to automatically perform a switching of states of a second receiving section 26 according to a paper size and type.

The printer 40, as illustrated in FIG. 12, more specifically, includes a control unit 42 that controls a switching unit 41 (refer to also FIG. 13) that switches the states of the second receiving section 26, and is configured such that the control unit 42 controls the switching unit 41 based on driver information, that is, information on a paper size and type to be set in a driver 43.

The switching unit 41, as illustrated in FIG. 13, includes a pinion gear 44, and a one-side rack member 45 and a the-other-side rack member 46, each including a rack engaging with the pinion gear 44. The one-side rack member 45 and the the-other-side rack member 46 are respectively provided with a push-up section 45*a* and a push-up section 46*a* at the end sections opposite to sides engaged with the pinion gear 44.

Similar to the first embodiment, as in FIG. 13, when the push-up section 45*a* and the push-up section 46*a* are located at the outer side of the second receiving section 26, the second receiving section 26 becomes in the second state. On the other hand, when the pinion gear 44 rotates in the clockwise direction in plan view of FIG. 13, the one-side rack member 45 moves in the −X-axis direction and the the-other-side rack member 46 moves in the +X-axis direction. Then, when the push-up section 45*a* and the push-up section 46*a* are located inward of the second receiving section 26, the second receiving section 26 becomes in the first state.

The pinion gear 44 (FIG. 13) of the switching unit 41 is configured to be rotatable by driving force of a driving motor 47. When the driving motor 47 is driven and the pinion gear 44 rotates, the second receiving section 26 is switched between the first state and the second state.

The driving motor 47 is configured such that a motor shaft (not illustrated) can rotate forward and reverse. Accordingly, the pinion gear 44 can be rotated in the clockwise direction and the counter-clockwise direction in FIG. 13.

As illustrated in FIG. 12, the printer 40 including the control unit 42 is configured to acquire settings of the paper size and type through the driver 43, and cause the control unit 42 to drive the driving motor 47 which drives the pinion gear 44 of the switching unit 41 based on the acquired information. The settings of paper size and type can be performed by an operating panel 10.

The printer 40 can also be configured to acquire the information on paper through a driver installed in a computer (not illustrated) connected to the printer.

In the printer 40 configured as described above, the switching of the states of the second receiving section 26 can automatically be performed by the control unit 42 based on the driver information related to the paper size, type, and the like.

The invention is not limited to the embodiments described above. Various modifications of the invention are possible within the scope of the invention described in aspects and it goes without saying that the modifications are also included within the scope of the invention.

The entire disclosure of Japanese Patent Application No.: 2016-229115, filed Nov. 25, 2016 is expressly incorporated by reference herein.

What is claimed is:

1. A recording apparatus comprising:

a recording unit that records on a medium;

a discharge unit that discharges the medium recorded by the recording unit; and a medium receiving tray that receives the medium discharged by the discharge unit, the medium receiving tray being at least partially located outside of a housing of the recording apparatus, and wherein the medium receiving tray includes a pair of projecting sections provided on both side sections in a medium width direction, which is a direction intersecting a medium discharge direction, and a deformation restricting section which supports the medium between the pair of projecting sections and restricts a deformation of the medium supported by the pair of projecting sections, wherein the pair of projecting sections project higher than the deformation restricting section.

2. The recording apparatus according to the claim 1, wherein, in a case where a first size medium is discharged by the discharge unit, both end sides of the first size medium in the medium width direction are supported by the pair of projecting sections, and wherein, in a case where a second size medium, in which a size in the medium width direction thereof is small compared with that of the first size medium, is discharged by the discharge unit, both end sides of the second size medium in the medium width direction are supported between the pair of projecting sections.

3. The recording apparatus according to the claim 2, wherein the deformation restricting section includes a first supporting surface, which is located at a center between the pair of projecting sections in the medium width direction, and a second supporting surface, which extends from the projecting sections toward the first supporting surface.

4. The recording apparatus according to claim 1, wherein the medium receiving tray includes a first receiving section that receives a medium, and a second receiving section that includes the pair of projecting sections and receives the medium at a position closer to the discharge unit than the first receiving section, and wherein the second receiving section is disposed symmetrically with respect to a center in the medium width direction, and outer side edges thereof in the medium width direction extend from an upstream side toward a downstream side in a medium discharge direction and toward the center.

5. The recording apparatus according to claim 4, wherein the first receiving section has a shape in which an upward inclination angle thereof becomes steep from an upstream side toward a downstream side in a medium discharge direction.

6. The recording apparatus according to claim 5, wherein the second receiving section is provided to be switchable between a first state and a second state which projects from the first receiving section compared with the first state.

7. The recording apparatus according to claim 6, wherein the second receiving section projects from the first receiving section in the first state.

8. The recording apparatus according to claim 6, further comprising:

a switching unit that switches states of the second receiving section; and a control unit that controls the switching unit, wherein the control unit controls the switching unit based on driver information.

9. The recording apparatus according to claim 6, wherein a recessed section is formed on an end section, of the medium receiving tray, on a downstream side in a medium discharge direction, and an operating section for switching the states of the second receiving section is disposed on the recessed section.

10. A recording apparatus comprising:

a recording unit that records on a medium;

a discharge unit that discharges the medium recorded by the recording unit; and a medium receiving tray that receives the medium discharged by the discharge unit, wherein the medium receiving tray includes:

a first receiving section that receives a medium, and a pair of second receiving sections that is provided on both side sections in a medium width direction of the first receiving section and that receive the medium at a position closer to the discharge unit than the first receiving section, and wherein the pair of second receiving sections is provided to be switchable between a first state and a second state which projects from the first receiving section compared with the first state.

* * * * *